US006474273B1

(12) United States Patent
Kinoshita et al.

(10) Patent No.: US 6,474,273 B1
(45) Date of Patent: Nov. 5, 2002

(54) CONTROL SYSTEM FOR REVERSIBLE INTERNAL COMBUSTION ENGINE

(75) Inventors: Atsufumi Kinoshita, Numazu (JP); Tomohiro Iwaki, Numazu (JP)

(73) Assignee: Kokusan Denki Co., Ltd., Shizuoka-ken (JP)

( * ) Notice: Subject to any disclaimer, the term of this patent is extended or adjusted under 35 U.S.C. 154(b) by 0 days.

(21) Appl. No.: 09/836,011

(22) Filed: Apr. 17, 2001

(30) Foreign Application Priority Data

Apr. 20, 2000 (JP) ..... 2000/119457

(51) Int. Cl.[7] ..... F01L 13/02
(52) U.S. Cl. ..... 123/41 E
(58) Field of Search ..... 123/41 E, 41 R, 123/599, 406.56

(56) References Cited

U.S. PATENT DOCUMENTS 5,161,489 A * 11/1992 Morooka ..... 123/41 E
5,782,210 A * 7/1998 Venturoli et al. ..... 123/41 E
6,044,807 A * 4/2000 Hata ..... 123/41 E
6,098,574 A * 8/2000 Arakawa et al. ..... 123/41 E
6,234,119 B1 * 5/2001 Tsukada et al. ..... 123/41 E

* cited by examiner

*Primary Examiner*—Gene Mancene
*Assistant Examiner*—Hyder Ali
(74) *Attorney, Agent, or Firm*—Pearne & Gordon LLP

(57) ABSTRACT

A control system for a reversible internal combustion engine comprising an AC magneto generator to generate an AC output voltage and a signal generator to generate pulse signals of polarity different from each other with a relation between the phases of the AC output and the pulse signals set so that the half waves of the output voltage having the same polarity when the two pulse signals of different polarities are generated whereby the rotational direction of the engine is judged from the polarity of the half wave of the output voltage of the magneto generator when the signal generator generates the pulse signal of either polarity and the engine is ignited at the low speed ignition position after it is confirmed that the rotational direction of the engine is reversed.

6 Claims, 8 Drawing Sheets

FORWARD ROTATION
30°
Ve
θ10
θ20
θ

Z
Vsa1
Vsa2

Vsb1
Vsb2
θ11
θ12
θ13
θ21
θ22
θ23
REVERSE ROTATION

Vsa1'
Vsa2'
Vsb1'
Vsb2'

CONTROL SYSTEM FOR REVERSIBLE INTERNAL COMBUSTION ENGINE

TECHNICAL FIELD OF THE INVENTION

This invention pertains to a control system for a two-cycle internal combustion engine having a function of changing a rotational direction of the two-cycle internal combustion engine.

BACKGROUND OF THE INVENTION

There has been used a small-sized two-cycle internal combustion engine as a power source for a vehicle such as a scooter, a snowmobile, a buggy car and so on for which a simplification is important and there has been generally used a centrifugal clutch type continuously variable transmission as a power transmission gear to transmit an output of the internal combustion engine to a drive wheel. There has been the continuously variable transmission having a backup gear assembled therein because small size, lightness, inexpensiveness and simple manipulation are important for that kind of vehicle.

Since the vehicle having no backup gear assembled therein cannot move back, the whole vehicle has to be lifted up in order to change the traveling direction in a narrow place, which causes the manipulation to be poorer.

The U.S. Pat. No. 5,036,802 discloses a control system for an internal combustion engine adapted to change a traveling direction of a vehicle by changing a rotational direction of the two-cycle internal combustion engine in consideration of the characteristic in which the two-cycle internal combustion engine can rotate in either of forward and reverse directions.

The apparatus illustrated in the U.S. Pat. No. 5,036,802 is adapted to firstly fail to ignite the two-cycle internal combustion engine when a reversion command is applied to the engine to lower the rotational speed thereof Thereafter, as the revolution rate of the engine is so sufficiently lowered as to get fully lower inertia of a piston, an ignition position of the engine (a rotation angle position of a rotary shaft of the engine when it is ignited) is advanced to an over-advanced position (a position where the ignition position of the engine is more advanced than the proper maximum advance position on a steady-state operation of the engine). As the engine is ignited at the over-advance position in the condition of the engine having the fully lower inertia, the piston moving toward the top dead center is forced backward so that the engine rotates in the reverse direction. In this manner, after the reversion of the rotational direction of the engine is confirmed, the engine can be operated while the rotational direction is kept reversed by igniting the engine at the proper ignition position in that rotational direction.

In the internal combustion engine control system illustrated in the U.S. Pat. No. 5,036,802, the four-pole magneto generator is used which is mounted on the internal combustion engine. The rotational direction of the engine is judged from the phase of positive or negative half waveform of a two cycle AC voltage generated by the magneto generator whenever it rotates one revolution and as the reversion of the rotational direction of the engine is judged, the engine is adapted to be operated while the rotational direction is kept reversed by igniting the engine at the proper ignition position in that rotational direction.

However, with the system constructed in such a manner, since the rotational direction of the engine cannot be judged unless the four-pole magneto generator is used, the magneto generator having more poles cannot be used for improving the output thereof.

There has been proposed a control system for an internal combustion engine control system which comprises two signal generators generating signals in synchronization with the rotation of the engine while they are displaced from each other in the rotational direction and detects the rotational direction of the engine from the phase relation of the signals generated from the signal generators as disclosed in U.S. Pat. No. 5,794,574.

Such a control system as detects the rotational direction of the engine from the signals generated by the signal generators separately provided from the magneto generator requires no four-pole magneto generator and therefore can have the multi-pole magneto generator, which enables more electric power to be taken out of the generator.

However, with the rotational direction of the engine adapted to be judged by using only the output of the signal generators, since the two signal generators are required, the construction of the engine cannot be avoided from being complicated.

SUMMARY OF THE INVENTION

Accordingly, it is a principal object of the invention to provide an internal combustion engine control system adapted to detect a rotational direction of an internal combustion engine by using only one signal generator so that the reversion of the rotational direction of the engine can be controlled without any complicated construction of the engine.

In accordance with the present invention, there is provided a control system for an internal combustion engine comprising a rotational direction change-over switch to be operated when a rotational direction of a two-cycle internal combustion engine should be reversed and a microcomputer to perform a speed reduction step to reduce the rotational speed of the internal combustion engine when the rotational direction change-over switch is operated, an over-advance angle control step to advance an ignition position of the internal combustion engine to an over-advance position when the rotational speed is reduced to less than a set value, a rotational direction judgment step to judge the rotational direction to confirm whether the rotational direction of the internal combustion engine is reversed by the over-advance angle of the ignition position and a reversion initial ignition step to ignite the internal combustion engine at the low speed ignition position in the condition of reversing the rotational direction when the reversion of the rotational direction is confirmed, the control system further comprising an AC magneto generator constructed to generate an AC output voltage of 2n cycles ("n" is an integral number of more than 1) per revolution of the internal combustion engine with a phase of the AC output voltage being set so that either of zero cross points of the AC output voltage corresponds to the low speed ignition position on the reverse rotation of the internal combustion engine and a signal generator constructed to generate a pulse signal of one of the polarities and a pulse signal of other polarity in synchronization with the rotation of the internal combustion engine with generation positions of the pulse signals being set so that the pulse signals of one polarity and of other polarity are generated at the low speed ignition position on the forward direction of the internal combustion engine and at the position advanced relative to the low speed ignition position, respectively and so that the polarity of one half wave of the AC output voltage of the magneto generator when the pulse signal of one polarity is generated is identical to the polarity of one half wave of the AC output voltage of the magneto generator when the pulse signal of other polarity is generated.

With the magneto generator and the signal generator provided in this manner, the polarities of the half waves of the output voltage of the magneto generator when the signal generator generates each pulse signal are different from each other relative to the forward rotation and the reverse rotation of the engine. This invention judges the rotational direction of the engine by utilizing this difference of polarity. More particularly, the microcomputer is programmed to judge the rotational direction of the internal combustion engine from the polarity of the half wave of the AC output voltage of the magneto generator when the signal generator generates the pulse signal of either polarity.

In a preferred embodiment of the invention, the microcomputer accomplishes rotational direction judgment means to judge the rotational direction of the engine, ignition position arithmetical operation means to arithmetically operate the ignition position of the internal combustion engine, steady-state operation ignition control means to control the ignition of the internal combustion engine on a steady-state operation and rotational direction change-over means to control the engine when the rotational direction of the engine should be reversed.

The rotational direction judgment means is so constructed as to judge the rotational direction of the internal combustion engine from the polarity of the half wave of the AC output voltage when the signal generator generates the pulse signal of either polarity.

The ignition position arithmetical operation means arithmetically operates the ignition positions of the internal combustion engine when it rotates forwardly and reversely at a set value or more than of the rotational speed, respectively. The ignition position is arithmetically operated in the form of time (the number of clock pulses counted by a timer) measured by the timer provided in the microcomputer while the rotary shaft of the engine rotates from the specific rotation angle position (the position where the measurement starts) to the ignition position. The positions where the measurement of the ignition position starts vary on the forward rotation and the reverse rotation of the engine.

The steady-state operation ignition control means is so constructed as to ignite the internal combustion engine when the ignition position arithmetically operated by the ignition position arithmetical operation means is detected in the condition where the internal combustion engine rotates forwardly and reversely at the set value or more than of the rotational speed, to ignite the internal combustion engine when the pulse signal of one polarity generated by the signal generator is detected in the condition where the internal combustion engine forwardly rotates at less than the set value of the rotational speed and to ignite the internal combustion engine when the zero cross point of the AC output voltage corresponding to the low speed ignition position of the reverse rotation is detected in the condition where the internal combustion engine reversely rotates at less than the set value of the rotational speed.

The rotational direction change-over means includes speed reduction means to reduce the rotational speed of the internal combustion engine when the rotational direction change-over switch is operated, ignition position over-advance means to ignite the internal combustion engine at an advance angle position necessary for reversing the rotational direction of the internal combustion engine when the rotational speed of the engine is reduced to the set value or less than and reversion initial ignition control means to ignite the internal combustion engine at a reversion initial ignition position suitable for a first ignition position after the rotational direction is reversed when the reversion of the rotational direction of the internal combustion engine is judged by the rotational direction judgment means.

The rotational direction change-over control means is so constructed to decide the reversion initial ignition position when the rotational direction of the internal combustion engine is changed from the forward direction to the reverse direction on the rotation angle position information obtained from the zero cross points of the AC output voltage of the magneto generator and to set the reversion initial ignition position when the rotational direction of the internal combustion engine is changed from the reverse direction to the forward direction, at a position where the signal generator generates the pulse signal of one polarity.

It should be noted that the positions where the measurement of the ignition position arithmetically operated when the engine rotates in the forward and reverse directions starts are set at the ones more advanced than the over-advance positions when the engine rotates in the forward and reverse directions, respectively, in order to enable the over-advance of the ignition position.

In this manner, the system of the invention can judge the rotational direction of the engine from the polarity of the half wave of the output voltage of the magneto generator when the signal generator generates the output pulses. This can prevent the construction of the engine from being complicated because the rotational direction of the engine can be judged by using only one signal generator.

In the invention, the information on the position where the measurement of the ignition position starts may be obtained from either the output of the signal generator or the output of the AC magneto generator.

More particularly, the steady-state operation ignition control means may be so constructed to start the measurement of the ignition position arithmetically operated by the ignition position arithmetical operation means when the signal generator detects the pulse signal of other polarity during the forward rotation of the internal combustion engine to ignite the internal combustion engine after the measurement of the ignition position ends and to start the measurement of the arithmetically operated ignition position when the signal generator detects the pulse signal of one polarity during the reverse rotation of the internal combustion engine to ignite the internal combustion engine after the measurement of the ignition position ends. Alternatively, it may be so constructed to start the measurement of the ignition position arithmetically operated by the ignition position arithmetical operation means when the specific zero cross point of the AC output voltage is detected to ignite the internal combustion engine after the measurement of the ignition position ends.

Otherwise, the steady-state operation ignition control means may be so constructed to start the measurement of the ignition position arithmetically operated by the ignition position arithmetical operation means when the pulse signal of other polarity generated by the signal generator is detected during the forward rotation of the internal combustion engine to ignite it after the measurement of the ignition position ends and to start the measurement of the ignition position arithmetically operated by the ignition position arithmetical operation means when the specific zero cross point of the AC output voltage is detected during the reverse rotation of the internal combustion engine to ignite it after the measurement of the ignition position ends.

The speed reduction control means may comprise means to stop an operation of an ignition system to misfire it, for instance.

In order to stop the operation of the ignition system, an electric power source may be made ineffective which supplies an igniting energy to the ignition system, a portion of the circuit elements of the ignition system may be shorted or the ignition command signal stops being supplied to the ignition system, for example.

BRIEF DESCRIPTION OF THE DRAWINGS

The above and other objects and features of the invention will be apparent from the detailed description of the preferred embodiment of the invention, which is described and illustrated with reference to the accompanying drawings, in which.

DETAILED DESCRIPTION OF PREFERRED EMBODIMENTS

Figure 1:
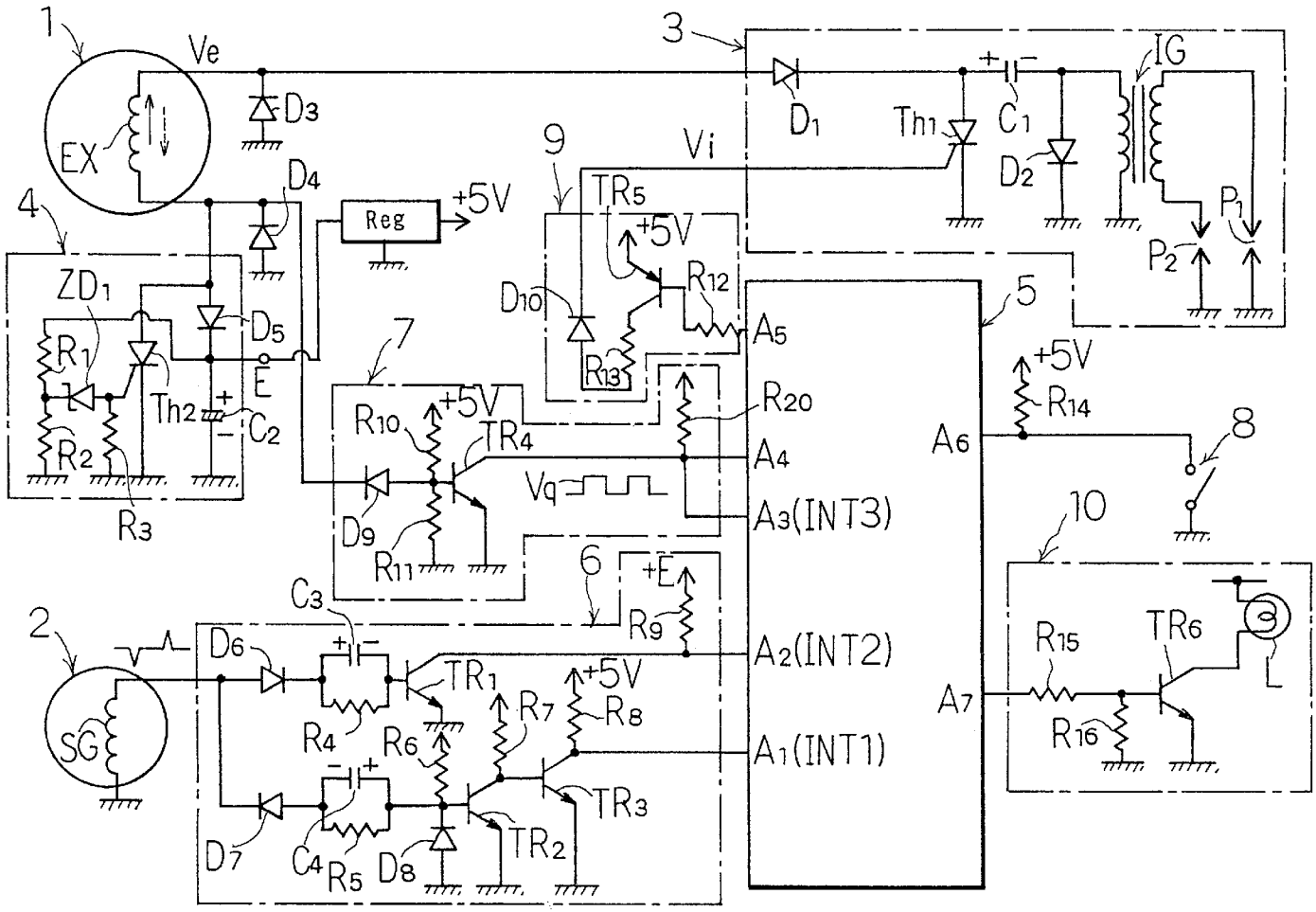
FIG. 1 is a schematic diagram of hardware of the internal combustion engine control system constructed in accordance with one embodiment of the invention.

Referring now to FIG. 1, there is shown a control system for an internal combustion engine constructed in accordance with one embodiment of the invention. An AC magneto generator 1 is mounted on a not shown two-cycle internal combustion engine which drives a vehicle such as a snowmobile. A signal generator 2 generates a pulse signal at a specific rotation angle position of the internal combustion engine. In FIG. 1 are also shown an ignition system 3 for igniting the internal combustion engine and a microcomputer 5 for controlling the ignition system 3. In the illustrated embodiment, the two-cycle internal combustion engine is illustrated to have two cylinders.

Figures 2A, 2B, 2C, 2D:
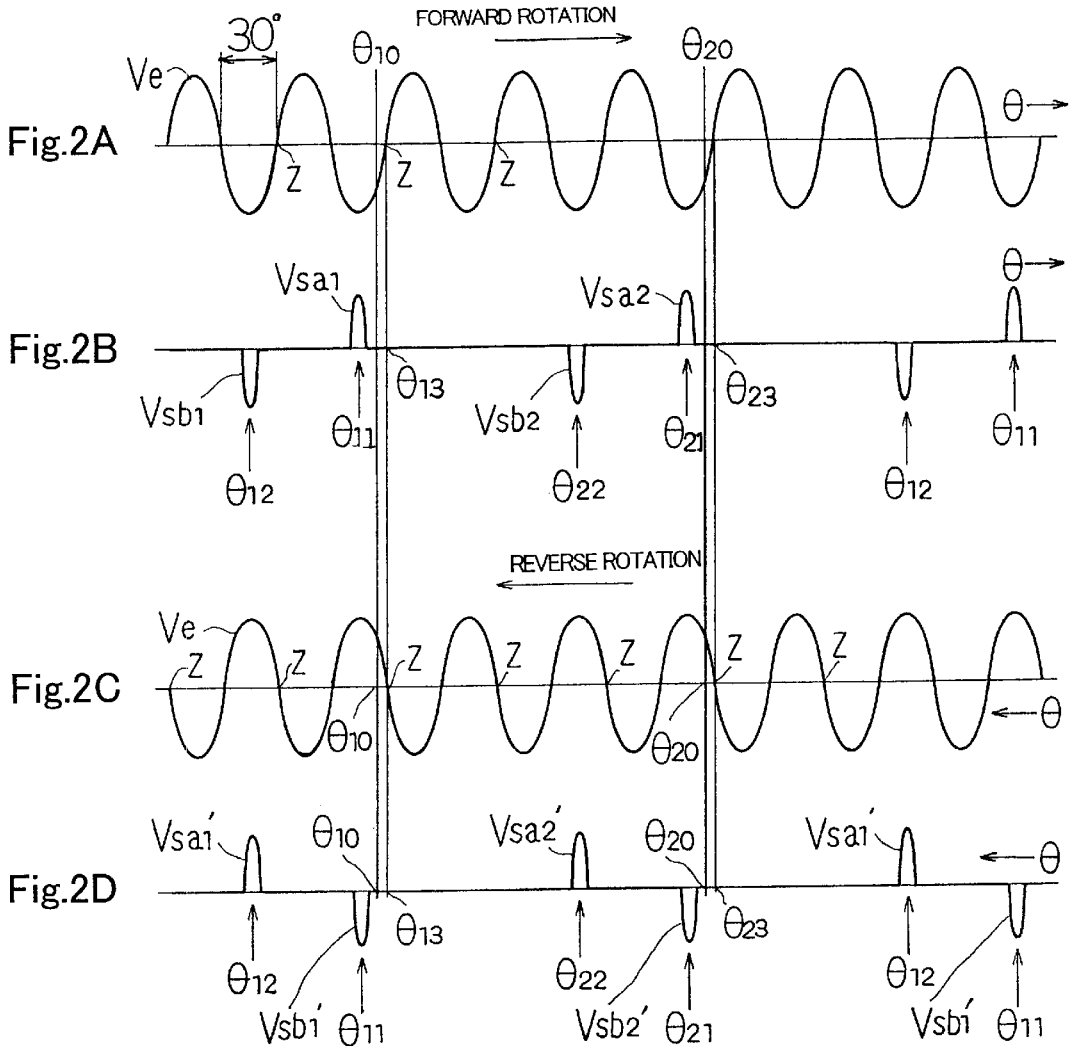
FIG. 2 illustrates waveforms of the output voltage of the magneto generator shown in FIG. 1 and waveforms of the pulse signals of the signal generator during the forward rotation of the internal combustion engine and during the reverse rotation thereof, respectively.

The magneto generator 1 may be of a conventional type and comprises a flywheel magnet rotor having multiple magnetic poles and mounted on a rotational shaft such as a crankshaft of the engine and a stator formed of generation coils wound on an armature core having multiple magnetic poles faced to the magnetic poles of the rotor. The stator may be securely provided on a mount of an engine case or the like. The magneto generator 1 comprises generation coils not shown for driving lamp loads or for charging a battery as well as an exciting coil EX as a generation coil for applying ignition energy to the ignition system 3. This magneto generator is so constructed that the generation coils on the stator generate an AC voltage of 2n cycle ("n" is an integral number of more than 1) during one revolution of the engine. In the illustrated embodiment, the rotor and the stator of the magneto generator are of twelve poles and therefore, the exciting coil EX generates an AC output voltage Ve of 6 cycles during one revolution of the engine as shown in FIGS. 2A and 2C. "θ" on a horizontal axis of FIG. 2 indicates a rotation angle of the rotational shaft of the engine. FIG. 2A shows a waveform of the output voltage of the exciting coil EX while the engine rotates in the forward direction and FIG. 2C shows a waveform of the output voltage of the exciting coil EX while the engine rotates in the reverse direction. As apparent from these figures, the phase of the output voltage of the exciting coil is inverted when the rotational direction of the engine is reversed. With the magneto generator constructed to be of the twelve poles, the rotation angle (the mechanical angle) corresponding to the period of each half wave of the output voltage of the exciting coil is 30 degree.

In the specification, the rotational direction of the engine when the vehicle moves in the forward direction is referred to as "forward direction" while the rotational direction of the engine when the vehicle moves in the backward direction is referred to as "reverse direction".

The signal generator 2 may be of a conventional type which generates the pulse signal by detecting reluctors on the rotor rotating in synchronization with the engine and is mounted on the engine case or the like so as to be faced to the rotor.

The signal generator comprises a core having magnetic poles faced to the reluctors, a signal coil SG wound on the core and a permanent magnet magnetically bonded with the core. The signal coil SG induces the pulse signals of different polarities due to variation in magnetic flux which occurs when the magnetic poles of the core begin to be faced to the leading edges of the reluctors and when they finish to be faced to them. In many cases, the rotor having the reluctors provided thereon may be formed of the flywheel constituting the yoke of the rotor of the magneto generator.

The signal generator is provided in order to provide the pulse signal for determining the ignition position of the engine when it rotates at low speed and the pulse signal for determining the time when the measurement of the ignition position of the engine starts. In the illustrated embodiment, since the internal combustion engine has the two cylinders, the pulse signal for determining the ignition position of the engine when it rotates at low speed and the pulse signal for determining the time when the measurement of the ignition position of the engine starts are required for the respective cylinders. Thus, the two reluctors are provided at a distance of 180 degree on the rotary body used together with the signal generator 2.

FIG. 2B shows the pulse signal generated by the signal generator 2 when the engine rotates in the forward direction while FIG. 2D shows the pulse signal generated by the signal generator 2 when the engine rotates in the reverse direction. In FIGS. 2B and 2D, θ10 and θ20 indicate the top dead center positions of the piston of the first and second cylinders of the engine (the rotation angle positions of the crankshaft when the piston reaches the top dead center), respectively.

The signal generator 2 generates the pulse signal Vsa1 of positive polarity (one polarity) at the low speed ignition position θ11 of the first cylinder set at the position slightly advanced by the mechanical angle of 5 degree, for instance relative to the top dead center position θ10 of the first cylinder while the engine rotates in the forward direction and generates the pulse signal Vsb2 of negative polarity (other polarity) at the rotation angle position θ12 fully advanced relative to the low speed ignition position θ11 on the rotation of the engine in the forward direction. In this embodiment, the angular width (arcuate angle) of the reluctors detected by the signal generator 2 is set at 60 degree as shown in FIG. 2B. Thus, it will be noted that the angle between the low speed ignition position θ11 and the rotation angle position θ12 is equal to 60 degree.

The signal generator 2 generates the pulse signal Vsa2 of positive polarity (one polarity) at the low speed ignition position θ21 of the second cylinder set at the position slightly advanced at the mechanical angle of 5 degree, for instance relative to the top dead center position θ20 of the second cylinder while the engine rotates in the forward direction and generates the pulse signal Vsb2 of negative polarity (other polarity) at the rotation angle position θ22 fully advanced relative to the low speed ignition position θ21 on the rotation of the engine in the forward direction as shown in FIG. 2B.

The signal generator 2 also generates the pulse signal Vsb1' of negative polarity (other polarity) at the rotation angle position θ11 of the first cylinder slightly delayed by the mechanical angle of 5 degree, for instance relative to the top dead center position θ10 of the first cylinder while the engine rotates in the reverse direction and generates the pulse signal Vsa1' of positive polarity (one polarity) at the rotation angle position θ12 further delayed relative to the rotation angle position θ11 while the engine rotates in the reverse direction as shown in FIG. 2D.

The signal generator 2 also generates the pulse signal Vsb2' of negative polarity (other polarity) at the rotation angle position θ21 of the second cylinder slightly delayed by the mechanical angle of 5 degree, for instance relative to the top dead center position θ20 of the second cylinder while the engine rotates in the reverse direction and generates the pulse signal Vsa2' of positive polarity (one polarity) at the rotation angle position θ22 further delayed relative to the rotation angle position θ21 while the engine rotates in the reverse direction as shown in FIG. 2D.

In this invention, the generation positions of the pulse signals are so set that the polarity of the half wave of the AC output voltage of the magneto generator 1 when the pulse signals Vsa and Vsa' of one polarity are generated is identical to the polarity of the half wave of the AC output voltage of the magneto generator 1 when the pulse signals Vsb and Vsb' of other polarity are generated even though the engine rotates either in the forward direction or the in the reverse direction. In the illustrated embodiment, the phase relation of the output of the signal generator 2 and the output of the magneto generator 1 is so set that the magneto generator 1 generates the voltage half wave of negative polarity when the signal generator 2 generates the pulse signal Vsa of positive polarity and the pulse signal Vsb of negative polarity, respectively during the rotation of the engine in the forward direction while the magneto generator 1 generates the voltage half wave of positive polarity when the signal generator 2 generates the pulse signal Vsa' of positive polarity and the pulse signal Vsb' of negative polarity, respectively during the rotation of the engine in the reverse direction.

Thus, it will be noted that the rotational direction of the engine can be judged by seeing the polarity of the half wave of the output voltage of the magneto generator 1 when the signal generator 2 generates the pulse signals Vsa or Vsa' of positive polarity or the polarity of the half wave of the output voltage of the magneto generator 1 when the signal generator 2 generates the pulse signals Vsb or Vsb' of negative polarity. The feature of the invention is to judge the rotational direction of the engine by using the relation of the output pulses of the signal generator and the output voltage of the magneto generator.

In the invention, the phase of the AC output voltage of the magneto generator 1 is so set that either of the zero cross points of the AC output voltage Ve of the magneto generator 1 is coincident with the low speed ignition position while the internal combustion engine rotates in the reverse direction. In the illustrated embodiment, the relation between the phase of the output voltage of the magneto generator and the rotation angle position of the internal combustion engine is so set that the fourth zero cross point θ13 or θ23 of the output voltage of the magneto generator appearing after the signal generator 2 generates the pulse signal Vsa' of positive polarity during the reverse rotation of the engine as shown in FIG. 2D.

In order to detect the low speed ignition position θ13 on the reverse rotation of the engine as shown in FIG. 2D, the specific zero cross point appearing when the AC output voltage Ve is transferred from the negative half wave to the positive half wave should be detected among the zero cross points of the AC output voltage Ve. Thus, it will be noted that the second specific zero cross point after the signal generator 2 generates the pulse signal Vsa' of positive polarity on the reverse rotation of the engine should be detected for the low speed ignition position.

The ignition system 3 serves to supply an igniting high voltage to ignition plugs P1 and P2 provided in the first and second cylinders of the engine, respectively, when ignition command signals to instruct the ignition of the first and second cylinders are applied. This ignition system comprises an ignition coil IG and a primary current control circuit to generate abrupt variation in a primary current of the ignition coil at the ignition position of the internal combustion engine.

In the illustrated embodiment, there is used the simultaneous firing type capacitor discharging ignition system that generates ignition sparks at the ignition plugs of the first and second cylinders by applying the ignition high voltage to them.

The illustrated ignition system comprises the ignition coil IG having one end of a primary coil grounded to earth, an igniting capacitor C1 provided on the primary side of the ignition coil to be charged with the shown polarity through a diode DI by the output of the exciting coil EX, a thyristor Th1 provided so that the capacitor CI is discharged through the primary coil of the ignition coil IG when it is turned on and a diode D2 connected in parallel to the primary coil of the ignition coil IG so that it is faced for the charging current of the capacitor to flow in a forward direction. The ignition plugs P1 and P2 in the first and second cylinders of the engine are connected between both ends of the secondary coil of the ignition coil IG and the earth, respectively.

In the illustrated embodiment, one end of the exciting coil EX is connected through the diode D1 to the igniting capacitor C1 and diodes D3 and D4 are connected between both ends of the exciting coil Ex and the earth, respectively, with the anode of them faced to the earth.

The ignition system is operated in a manner described below. As the exciting coil EX induces the positive voltage of half cycle indicated by a solid arrow in FIG. 1, the current flows through a route of the exciting coil Ex, the diode D1, the capacitor C1, the diode D2 or the primary coil of the ignition coil IG, the diode D4 and again the exciting coil EX so that the igniting capacitor C1 is charged with the polarity shown in FIG. 1. In this condition, as the ignition command signal Vi is given the gate of the thyristor Th1, it is turned on so that the capacitor C1 is discharged through the thyristor and the primary coil of the ignition coil IG. This induces the igniting high voltage across the secondary coil of the ignition coil IG and the high voltage is simultaneously applied across the ignition plugs P1 and P2. Thus, the ignition coils P1 and P2 generate spark discharge at the same time so that gas mixture is ignited in the cylinder where the ignition time comes. Since the cylinder where no ignition time comes is at the terminal of exhaust step, the simultaneous spark discharge in the latter cylinder can occur without any trouble.

In FIG. 1, an electric power circuit 4 serves to convert the negative half wave of the output of the exciting coil EX into constant DC voltage. The electric power circuit 4 comprises a capacitor C2 to be charged through a diode D5 by the output voltage of negative half wave indicated by a dotted arrow in FIG. 1, a thyristor Th2 provided so as to bypass from the capacitor C2 the charging current of the capacitor C2 through the diode D5 when the thyristor Th2 is turned on, a voltage detector circuit of a series circuit of resistors R1 and R2 connected to the capacitor C2, a Zenor diode ZD1 connected between the connection point of the resistors R1 and R2 and the gate of the thyristor Th2 with the anode of the Zenor diode faced to the thyristor Th2 and a resistor R3 connected between the gate and cathode of the thyristor Th2.

In the electric power circuit 4, the capacitor C2 is charged by the output voltage of the negative half wave from the exciting coil EX with the polarity shown in FIG. 1. As the voltage across the capacitor C2 reaches the set value, the Zenor diode ZD1 is turned on and applies a trigger signal to the thyristor Th2. This causes the thyristor Th2 to be turned on so as to interrupt the capacitor C2 from being charged. Thus, the voltage E across the capacitor C2 is kept at a constant value in the condition of the steady-state operation of the engine where a crest value of the output voltage of the exciting coil EX gets the set value or more than. The voltage across the capacitor C2 is input to a regulator (voltage regulator) Reg and a voltage of 5V from the regulator is applied to various portions of the control system as an electric power source voltage.

In FIG. 1, a microcomputer 5 to control the ignition system 3 is operated by the source voltage of 5V from the electric power circuit 4 through the regulator Reg. To the microcomputer 5 are input the output pulses of the signal generator 2 through a waveform shaping circuit 6, an output of a phase detector circuit 7 to detect a phase of the output voltage of the exciting coil EX and a signal given from a rotational direction change-over switch 8 operated when the rotational direction of the engine should be reversed. To the microcomputer 5 are connected an ignition command signal output circuit 9 and a reversion information circuit 10 to inform that the engine is rotating in the reverse direction.

The waveform shaping circuit 6 serves to convert the pulse signal generated by the signal generator 2 into a signal of waveform the microcomputer can recognize. The waveform shaping circuit 6 may comprise transistors TR1 through TR3, resistors R4 through R9, capacitors C3 and C4 and diodes D6 through D8. The signals obtained at the collectors of the transistors TR3 and TR1 of the waveform shaping circuit 6 are input as interruption signals INT1 and INT2 to ports A1 and A2 of the microcomputer 5.

In the illustrated waveform shaping circuit 6, as the pulse signals Vsb1, Vsb2, Vsb1' and Vsb2' of negative polarity generated by the signal generator 2 exceed the voltage (threshold value) across the capacitor C4, a current flows through a route of the signal coil SG, the diode D8, the resistor R5, the diode D7 and again the signal coil SG. Since a reverse bias is applied between the base and emitter of the transistor TR2 by the voltage drop generated across the diode D8, the transistor TR3 gets the on-state. Thus, as the pulse signals Vsb1, Vsb2, Vsb1' and Vsb2' of negative polarity exceed the threshold value, the potential at the collector of the transistor TR3 is lowered due to the on-state thereof. The microcomputer 5 can detect the generation of the pulse signals of negative polarity from the signal generator 2 by recognizing the lowered potential at the collector of the transistor TR3.

As the signal generator 2 generates the pulse signals Vsa1, Vsa2, Vsa1' and Vsa2' of positive polarity which exceed the voltage (threshold value) across the capacitor C3, a base current of the transistor TR1 flows from the signal coil SG through the resistor R4 and therefore the transistor TR1 gets the on-state so that the potential at the collector of the transistor TR1 is lowered. The microcomputer 5 can detect the generation of the pulse signals of positive polarity from the signal generator 2 by recognizing the lowered potential at the collector of the transistor TR1.

The phase detection circuit 7 may comprise a NPN transistor TR4 having a collector connected to ports A3 and A4 of the microcomputer 5 and an emitter grounded to the earth, resistors R10 and R11 connected between the base of the transistor TR4 and the output terminal of the electric power circuit 4 and between the base and emitter of the transistor TR4, respectively and a diode D9 connected between the base of the transistor TR4 and the other end of the exciting coil EX with a cathode faced to the exciting coil EX.

In the phase detection circuit 7, when the exciting coil EX generates the output voltage of half wave of negative polarity, the base current of the transistor TR4 flows from the regulator Reg through the resistor R10 and therefore the transistor TR4 is turned on. When the exciting coil EX generates the output voltage of half wave of positive polarity, the other end of the exciting coil EX gets a negative potential of about −0.7V relative to the earth due to the voltage drop generated across both ends of the diode D4 which is caused by the charging current of the capacitor C1. Thus, most of the current flowing through the base of the transistor TR4 until now is transferred through the exciting coil EX, which causes the transistor TR4 to be turned off.

In this manner, since the transistor TR4 gets the on-state while the exciting coil EX generates the output voltage of negative half wave and the off-state when it generates the output voltage of positive half wave, there is obtained a rectangular wave signal Vq which rises at the cross points where the output voltage of the exciting coil EX is transferred from the negative half wave to the positive half wave and drops at the zero cross points where the output voltage of the exciting coil EX is transferred from the positive half wave to the negative half wave. Each of the zero cross points of the output voltage from the exciting coil EX can be detected by recognizing the rising and the dropping of the rectangular wave signal.

In the embodiment, the specific zero cross points Z are the point where the output voltage of the exciting coil EX is transferred from the negative half wave to the positive half wave as shown in FIG. 2C and are detected by the microcomputer 5 recognizing the rising of the rectangular wave signal obtained at the collector of the transistor TR4. The second specific zero cross point detected after the signal generator 2 generates the pulse signal Vsa2' of positive polarity while the engine rotates reversely corresponds to the low speed ignition position θ13 of the first cylinder when the engine rotates reversely. Similarly, the second specific zero cross point Z detected after the signal generator 2 generates the pulse signal Vsa1' of positive polarity when the engine rotates reversely corresponds to the low speed ignition position θ23 when the engine rotates reversely.

The ignition command signal output circuit 9 may comprise a PNP transistor TR5 having an emitter connected to the output terminal of the electric power circuit 4 and a base connected through a resistor R12 to a port A5 of the microcomputer 5 and a diode D10 having an anode connected through a resistor R13 to a collector of the transistor TR5 and a cathode connected to the gate (an input terminal for the ignition command signal) of the thyristor Th1 of the ignition system 3. The cathode of the diode D10 serves as an output terminal of the ignition command signal output circuit 9.

As described later, the microcomputer 5 lowers the potential at the port A5 approximately to the earth potential when the ignition position is detected. Since this turns on the transistor TR5, the ignition command signal Vi is applied from the electric power circuit 4 through the emitter and collector of the transistor TR5, the resistor R13 and the diode D10 to the ignition system 3.

The rotational direction change-over switch 8 may comprise a manual operation switch which can change between the on-state and the off-state and is connected between a port A6 of the microcomputer 5 and the earth. The port A6 of the microcomputer 5 is connected through a resistor R14 to the output terminal of the electric power circuit 4. The microcomputer 5 judges from the states of the switch 8 whether the internal combustion engine is instructed to rotate forwardly or reversely. In the embodiment, when the switch 8 is in the off-state, the internal combustion engine is rotated forwardly and when the switch 8 is in the on-state, the internal combustion engine is rotated reversely.

The reverse rotation information circuit 10 may comprise a NPN transistor TR6 having an emitter connected to earth and a base connected through a resistor R15 to a port A7 of the microcomputer 5, a resistor R16 connected between the base and emitter of the transistor TR6 and a reversion information lamp L serving as information means connected between the non-grounded output terminal of the electric power circuit 4 and the collector of the transistor TR6. The reversion information lamp L may be replaced either by a luminous element such as a light emitting diode or by information means such as a sound generator. Both of the luminous element and the sound generator may be used.

In the illustrated embodiment, the microcomputer 5 may be programmed to perform a speed reduction step to reduce the rotational speed of the internal combustion engine when the rotational direction change-over switch 8 is operated, an over-advance angle control step to advance the ignition position of the internal combustion engine to an over-advance position when the rotational speed is reduced to less than the set value, a rotational direction judgment step to Judge the rotational direction of the engine to confirm whether the rotational direction of the internal combustion engine is reversed by the over-advance of the ignition position or not and a reversion initial ignition step to ignite the internal combustion engine at the low speed ignition position in the condition of reversing the rotational direction when the reversion of the rotational direction is confirmed.

An example of an algorithm of a program practiced by the microcomputer 5 of the control system for the internal combustion engine is illustrated in the flow charts of FIGS. 5 through 8.

Figure 5:
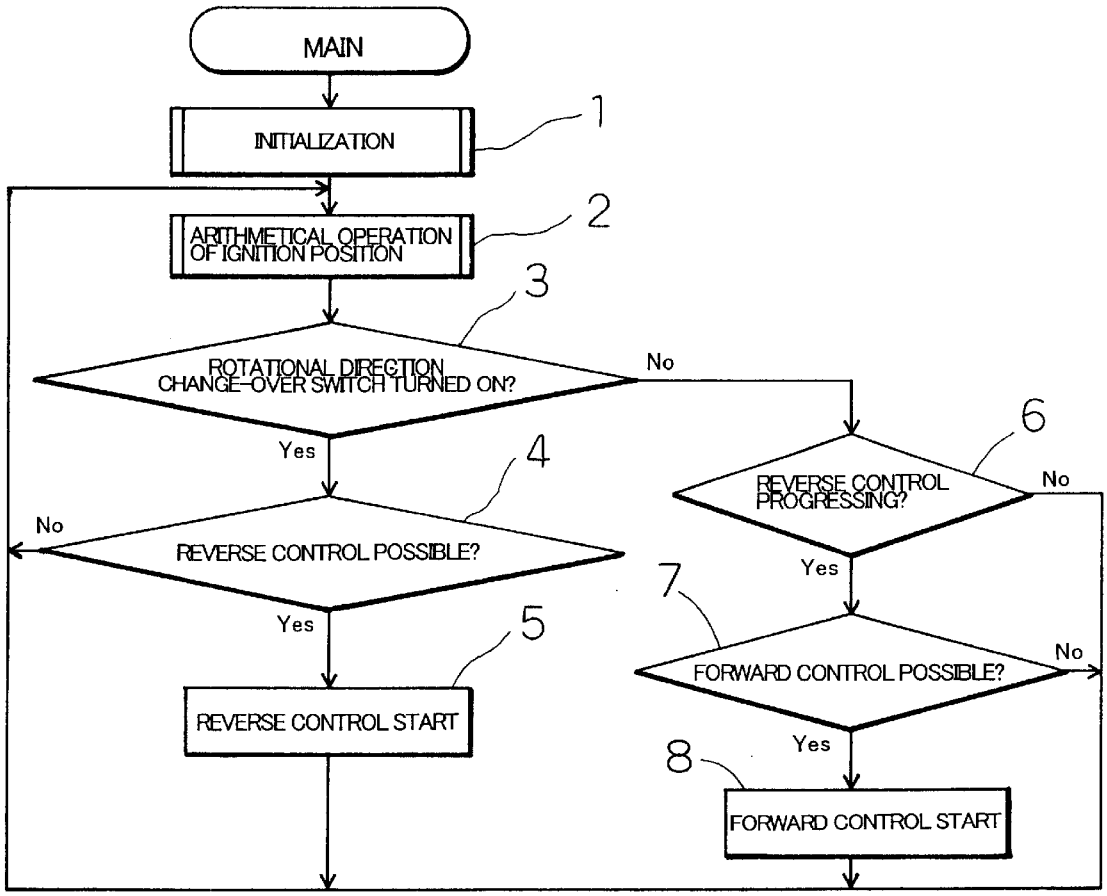
FIG. 5 is a flow chart which illustrates an algorithm of a main routine of a program practiced by the microcomputer of the control system of FIG. 1.

FIG. 5 shows a main routine of the program practiced by the microcomputer 5, which starts when a power source of the microcomputer 5 is established. As the main routine starts, various parts are initialized in the step 1 and the ignition positions of the cylinders are arithmetically operated in the step 2. In the step at which the ignition positions are arithmetically operated, the ignition positions of the respective cylinders are arithmetically operated relative to the momentary rotational speed of the engine arithmetically operated in a separate routine. The arithmetical operation of the ignition positions are made by using a map providing the relation between the rotational speed and the ignition position, for instance, which may be stored in the ROM of the microcomputer.

The ignition position when the engine is rotating forwardly is arithmetically operated in the form of a measurement value of time (the number of clock pulses to be measured) measured by an igniting timer while the engine rotates from a position where the signal generator 2 generates the pulse signal Vsb1 or Vsb2 of negative polarity to the ignition position. Similarly, the ignition position while the engine is rotating reversely is arithmetically operated in the form of a measurement value of time measured by an igniting timer while the engine rotates from a position where the signal generator 2 generates the pulse signal Vsa1' or Vsa2' of positive polarity to the ignition position.

After the arithmetical operation of the ignition positions of the respective cylinders, whether the rotational direction change-over switch 8 is in the on-state or not is judged in the step 3. When the switch 8 is in the onstate (when there is applied the command for reversion of the engine), whether a reverse control can be made or not is judged in the step 4. What is meant by "reverse control" is to change the rotational direction of the engine from the forward direction to the reverse direction.

In the step 4, whether the reverse control should be prohibited or not is judged in view of safety from the conditions of the engine or the conditions of the vehicle driven by the engine. It is judged that the reverse control can be made if they are not the conditions where it should be prohibited. What is meant by the conditions where it should be prohibited are the conditions where the rotational speed of the engine does not still exceed the idling speed (1500 r.p.m., for example) after the engine starts or where the rotational speed does not exceed the set value (900 r.p.m., for example) after the rotational direction of the engine is changed from the forward direction to the reverse direction (immediately after the rotational direction of the engine is changed from the forward direction to the reverse direction).

When it is judged in the step 4 that the reverse control can be made, the process is advanced to the step 5 where the reverse control starts. In the step, a reversion flag is set at 1. When it is judged in the step 4 that the reverse control should not be made, the process is returned to the step 2 where the ignition position is arithmetically operated.

In the step 3, when it is judged that the rotational direction change-over switch is not in the on-state or it is instructed that the rotational direction of the engine should be forward, the process is advanced to the step 6 where whether the reverse control is progressing or not (whether the reversion flag is set at 1 or not) is judged. When the progression of the reverse control (the reversion flag set at 1) is judged, the process is advanced to the step 7 where whether a forward control can be made or not is judged. For instance, the forward control should be prohibited immediately after the rotational direction of the engine is changed from the forward direction to the reverse direction. The forward control may be prohibited unless the rotational speed of the engine does not exceed 900 r.p.m. after the rotational direction of the engine is changed from the forward direction to the reverse direction. In case that there is no problem in safety, the forward control is allowed and the process is advanced to the step 8 where the forward control starts and the forward flag indicating that the forward control is progressing is set at 1. What is meant by "the forward control" is one in which the rotational direction of the engine is changed from the reverse direction to the forward direction.

In the step 6, when it is judged that the reverse control is not progressing and in the step 7, when it is judged that the forward control should not be made, the process is returned to the step 2.

Figure 6:
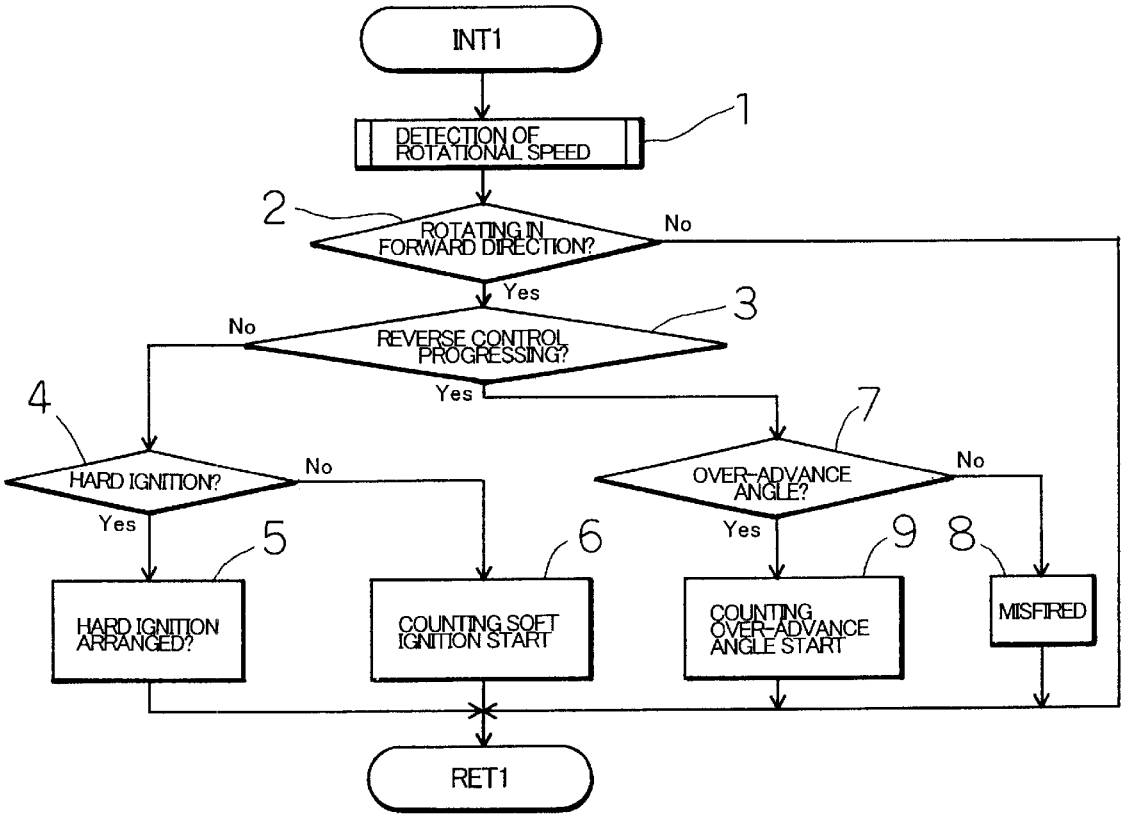
FIG. 6 is a flow chart which illustrates an algorithm of an interruption routine of the program practiced by the microcomputer of the control system of FIG. 1.

As the signal generator 2 generates the pulse signal Vsb1, Vsb2, Vsb1' or Vsb2' of negative or other polarity, the interruption signal INT1 is input to the port A1 of the microcomputer 5. With the interruption signal INT1 input, the main routine is interrupted and the interruption routine of FIG. 6 is carried out. In the interruption routine, the step 1 where the rotational speed of the engine is arithmetically operated is carried out. In the step 1, the rotational speed of the engine can be obtained from the time taken after the previous interruption is made by the interruption signal INT1 until the present interruption is made. The time can be detected by the difference between the count value of the counter counting the clock pulses within the microcomputer and read at present and the count value of the same counter read previously.

After the rotational speed of the engine is arithmetically operated in the step 1, the process is transferred to the step 2 where whether the rotational direction of the engine is forward or not is judged. The judgment of the rotational direction of the engine is made by the interruption routine of FIG. 7 which is carried out when the signal generator 2 generates the pulse signal of positive polarity.

In the step 2 of the interruption routine of FIG. 6, when it is judged that the rotational direction of the engine is reversed, the interruption ends without any process. In the step 2, when it is judged that the rotational direction of the engine is forward, the process is transferred to the step 3 where whether the reverse control is progressing or not is judged. If the reverse control is not progressing (if the reversion flag is not 1), the mode of the normal ignition position control is practiced. In this mode of the normal ignition position control, in the step 4 is judged whether the condition is the one where the hard ignition should be made or where the soft ignition should be made.

What is meant by "hard ignition" is to ignite the engine at a predetermined ignition position determined on the signal obtained from the hardware such as the signal generator 2 or the exciting coil 1. The hard ignition when the engine rotates in the forward direction is made when the signal generator 2 generates the pulse signal Vsa1 of positive polarity at the rotation angle position θ11 which is 5 degree prior to the top dead center of the first cylinder and generates the pulse signal Vsa2 of positive polarity at the rotation angle position θ21 which is 5 degree prior to the top dead center of the second cylinder. These rotation angle positions correspond to the low speed ignition positions of the first and second cylinders.

What is meant by "soft ignition" is to ignite the engine at the ignition position arithmetically operated by the software.

In the step 4 of FIG. 6, it is judged that the hard ignition should be made when the rotational speed of the engine is 1000 r.p.m. or less than while it is judged that the soft ignition should be made when it exceeds 1000 r.p.m.

When it is judged that the hard ignition should be made in the step 4, the process is advanced to the step 5 where the hard ignition is arranged. This is the preparation for giving an ignition command signal Vi to the ignition system 3 when the signal generator 2 generates the pulse signal of positive polarity. In the step 4, when it is judged that the soft ignition should be made, the process is advanced to the step 6 where the value of the ignition position measured in the main routine is set to the igniting timer which starts the counting.

In the step 3, when it is judged that the reverse control is progressing, the process is advanced to the step 7 where it is judged that the ignition position should be over-advanced or the engine is should be misfired. For example, it is judged that the engine should be misfired when the rotational speed of the engine is 500 r.p.m. or more than while the ignition position should be over-advanced when it is less than 500 r.p.m.

In the step 7, when it is judged that the engine should be misfired, the process is advanced to the step 8 where the mode of misfire is established to stop supplying the ignition command signal to the ignition system 3. In the step 7, when it is judged that the ignition position should be over-advanced, the process is advanced to the step 9 where the measured value of the ignition position previously set at the over-advanced position is set to the igniting timer which starts the counting.

The microcomputer 5 turns on the transistor TR5 by getting the earth potential at the port A5 when the measurement of the measured value of the ignition position previously set ends and applies the ignition command signal Vi to the ignition system 3.

Figure 7:
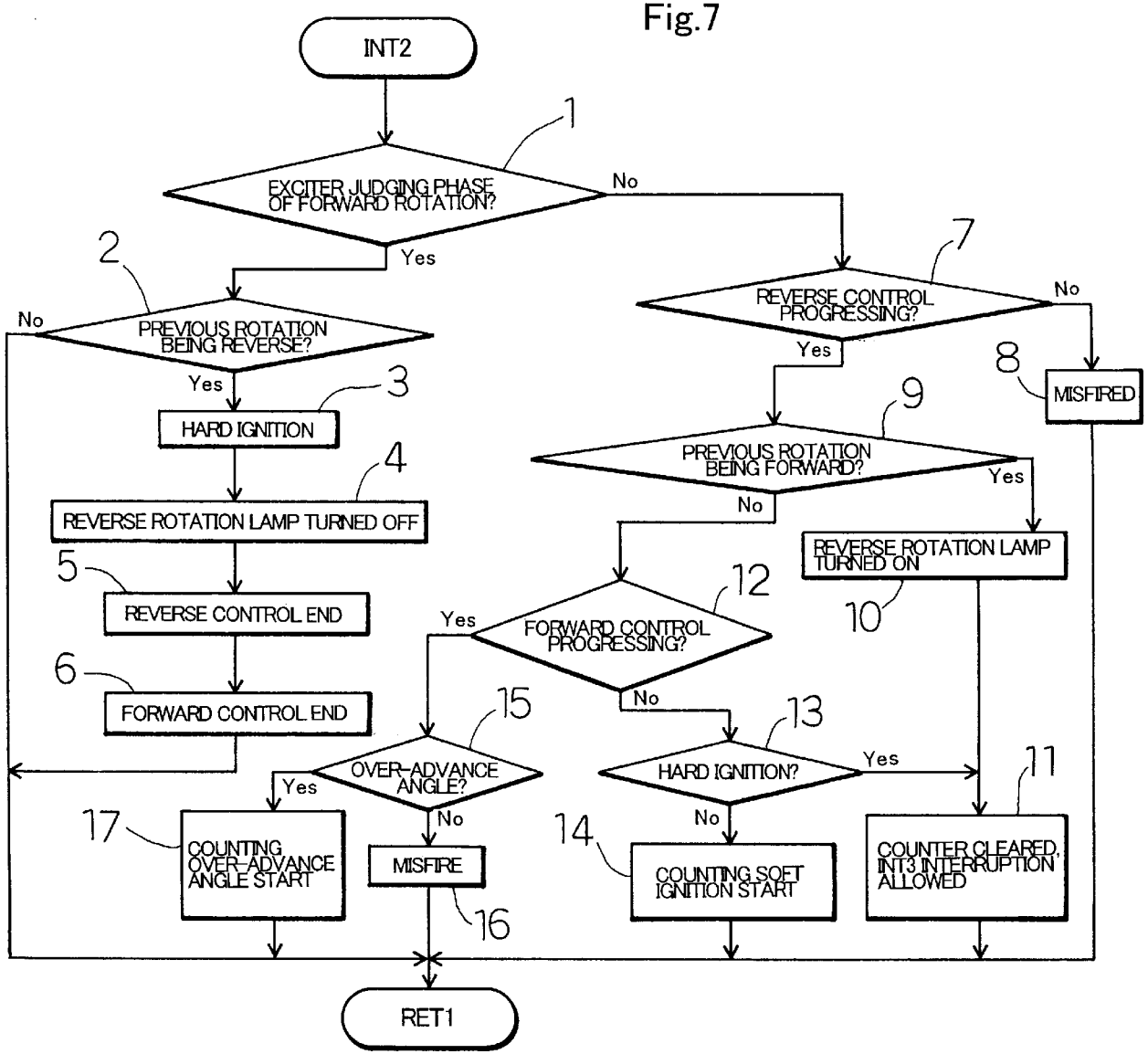
FIG. 7 is a flow chart which illustrates an algorithm of another interruption routine of the program practiced by the microcomputer of the control system of FIG. 1.

As the signal generator 2 generates the pulse signal Vsa1, Vsa2, Vsa1' or Vsa2' of positive polarity and the interruption signal INT2 is applied to the port A2 of the microcomputer 5, the interruption routine of FIG. 7 is practiced. In the step 1 of this interruption routine, it is judged whether the phase of the output voltage of the exciting coil EX is one indicating that the engine rotates in the forward direction or not, in view of the polarity of the half wave of the output voltage of the exciting coil (whether the polarity of the half wave of the output voltage of the exciting coil is negative or not when signal generator 2 generates the pulse signal of positive polarity). When the forward rotation of the engine is judged, the process is transferred to the step 2 where it is judged whether the rotational direction of the engine is reverse or not when the interruption is made by the previous interruption signal INT2. As a result, when the forward direction of the engine at the time of the previous interruption is judged, the process is returned to the main routine without doing anything. When the reverse direction of the engine at the time of the previous interruption is judged, the process is transferred to the step 3 where the ignition command signal Vi is applied to the ignition system 3 to make the hard ignition of the engine at the low speed ignition position (the position of generation of the pulse signal Vsa1 or Vsa2 of positive polarity) suitable for the first ignition position after the rotational direction of the engine is changed from the reverse direction to the forward direction. In other words, the reversion initial ignition course is done in the steps 2 and 3.

Thereafter, in the step 4 of FIG. 7, the potential at the port A7 is made almost the earth potential so that the transistor TR6 gets the off-state and the reversion lamp L is turned off. Then, in the step 5, the reversion flag is made "0" whereby the reverse control ends. In the step 6, the forward operation flag is made "0" whereby the forward control ends and then the process is returned to the main routine.

In the step 1 of FIG. 7, when it is judged that the rotational direction of the engine is reverse, the process is advanced to the step 7 where it is judged whether the reverse control is progressing or not. When it is judged that the reverse control is not progressing, the process is advanced to the step 8 where after the engine is misfired, the process is returned to the main routine.

In the step 7 of FIG. 7, when it is judged that the reverse control is progressing, the process is advanced to the step 9 where it is judged whether the rotational direction of the engine at the time of previous interruption is forward or not. When the forward direction is judged, the process is advanced to the step 10 where the port A7 gets the potential of high level and the reversion lamp L is lighted. Then, in the step 11, there is cleared the counter for judging which zero cross point of the output of the exciting coil EX appearing after the pulse signal Vsa2' or Vsa1' of positive polarity is generated corresponds to the specific one. Thus, after the interruption made by the interruption signal INT3 is allowed, the process is returned to the main routine.

In the step 9 of FIG. 7, when it is judged that the rotational direction of the engine at the time of the previous interruption is reverse, the process is advanced to the step 12 where whether the forward control is progressing or not is judged. As the result, when it is judged that the forward control is not progressing, the process is advanced to the step 13 where it is judged whether the hard ignition should be made or not. When it is judged that the hard ignition should be made, the process is advanced to the step 11.

In the step 13 of FIG. 7, when it is judged that the hard ignition should not be made, the process is advanced to the step 14 where the measured value of the arithmetically operated ignition position is set to the igniting timer which starts the measurement of the measured value.

In the step 12 of FIG. 7, when it is judged that the forward control is progressing, the process is advanced to the step 15 where it is judged whether the ignition position should be over-advanced in accordance with the rotational speed of the engine at that time or the engine should be misfired. For example, if the rotational speed of the engine is 500 r.p.m. or more than, it is judged that the engine should be misfired and the process is advanced to the step 16 where the engine is misfired. In the step 15, if the rotational speed of the engine is less than 500 r.p.m., it is judged that the ignition position should be over-advanced, the process is advanced to the step 17 where the measuring value of the over-advanced position is set to the igniting timer which starts the measurement.

Figure 8:
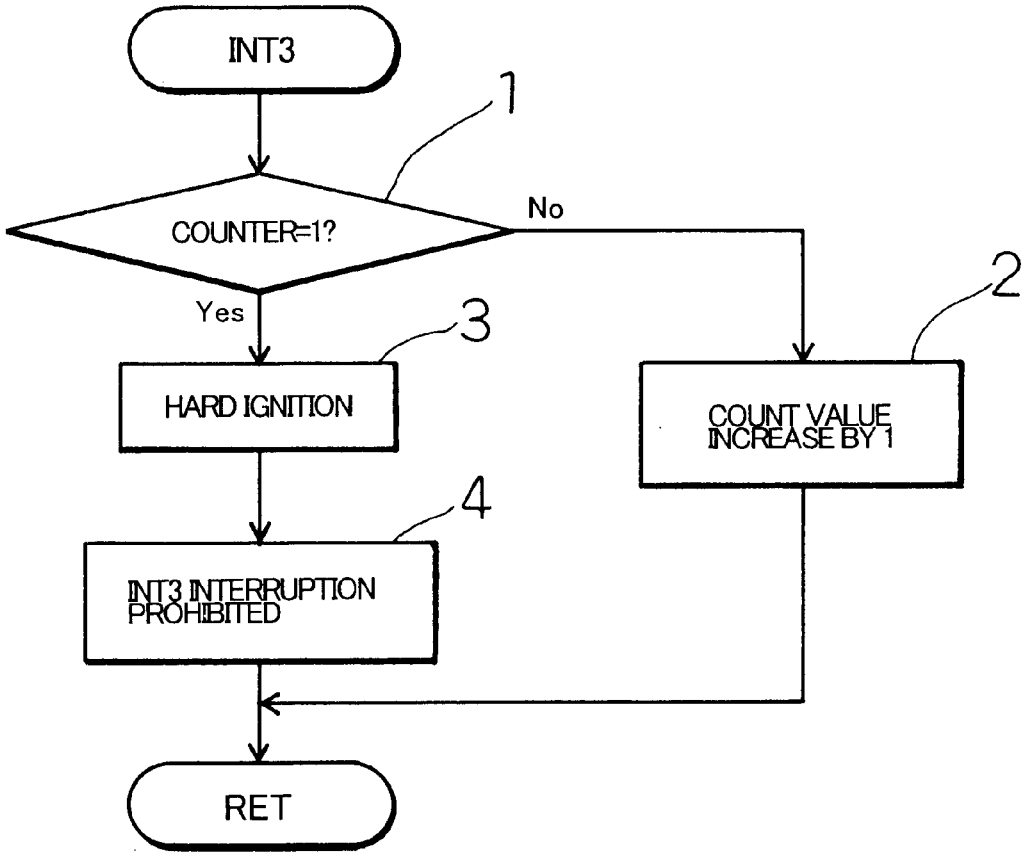
FIG. 8 is a flow chart which illustrates an algorithm of a further interruption routine of the program practiced by the microcomputer of the control system of FIG. 1.

The interruption signal INT3 is applied to the port A3 of the microcomputer 5 whenever the phase detection circuit 7 detects the zero cross point passing when the output voltage of the exciting coil EX is transferred from the negative half wave to the positive half wave. In the step 11 of FIG. 7, while the interruption signal INT3 allows the interruption, the interruption routine of FIG. 8 is practiced when the interruption signal INT3 is applied. In the interruption routine, in the step 1, it is judged whether the count value of the counter for judging the zero cross point is 1 or not. If it is not 1, the process is advanced to the step 2 where the count value of the counter increases by 1 and thereafter the process is returned to the main routine.

In the step 1 of FIG. 8, when it is judged that the count value of the counter is 1 [in case that the specific zero cross point Z generated by the present interruption signal INT3 corresponds to the second specific zero cross point Z (the position θ13 of FIG. 2) after the pulse signal Vsa1' or Vsa2' of positive polarity is generated at the time of reversal of the engine], the process is advanced to the step 3 where the port A5 gets the earth potential, which causes the hard ignition (the reversion initial ignition) to be made. Thereafter, in the step 4, the interruption by the interruption signal INT3 is prohibited and the process is returned to the main routine.

In the illustrated embodiment, the step 1 of the interruption routine of FIG. 7 accomplishes the rotational direction judgment means to judge the rotational direction of the internal combustion engine in view of the polarity of the half wave of the AC output voltage of the magneto generator when the signal generator generates the pulse signal of either polarity (the pulse signal of positive polarity, in the illustrated embodiment).

The step 2 of the main routine of FIG. 5 accomplishes the ignition position arithmetical operation means to arithmetically operate the ignition position of the internal combustion engine when it rotates in the forward or reverse direction at the set rotational speed or more than.

The steps 2 through 6 of the interruption routine of FIG. 6 and the steps 7, 9, 12, 13, 14 and 11 of the interruption routine of FIG. 7 accomplish steady-state operation ignition control means to ignite the internal combustion engine when the ignition position arithmetically operated by the ignition position arithmetical operation means is detected in the condition where the internal combustion engine rotates forwardly or reversely at the rotational speed of the set value or more than, to ignite the internal combustion engine when the pulse signal of one polarity generated by the signal generator is detected in the condition where the internal combustion engine forwardly rotates at the rotational speed of less than the set value and to ignite the internal combustion engine when the zero cross point of the AC output voltage corresponding to the low speed ignition position is detected in the condition where the internal combustion engine reversely rotates at the rotational speed of less than the set value.

Further, the steps 7 and 8 of FIG. 6 and the steps 7, 8, 15 and 16 of FIG. 7 accomplish speed reduction means to reduce the rotational speed of the internal combustion engine when the rotational direction change-over switch is operated and the steps 15 and 17 of FIG. 7 accomplish ignition position over-advance means to ignite the internal combustion engine at an over-advance angle position necessary for reversing the rotational direction of the internal combustion engine when the rotational speed is reduced to the set value or less than.

The steps 1 through 3, 7, 9 and 11 of FIG. 7 and the interruption routine of FIG. 8 accomplish reversion initial ignition control means to ignite the internal combustion engine at a reversion initial ignition position suitable for a first ignition position after the rotational direction is reversed when the reversion of the rotational direction of the internal combustion engine is decided by the rotational direction judgment means.

Figures 3A, 3B, 3C:
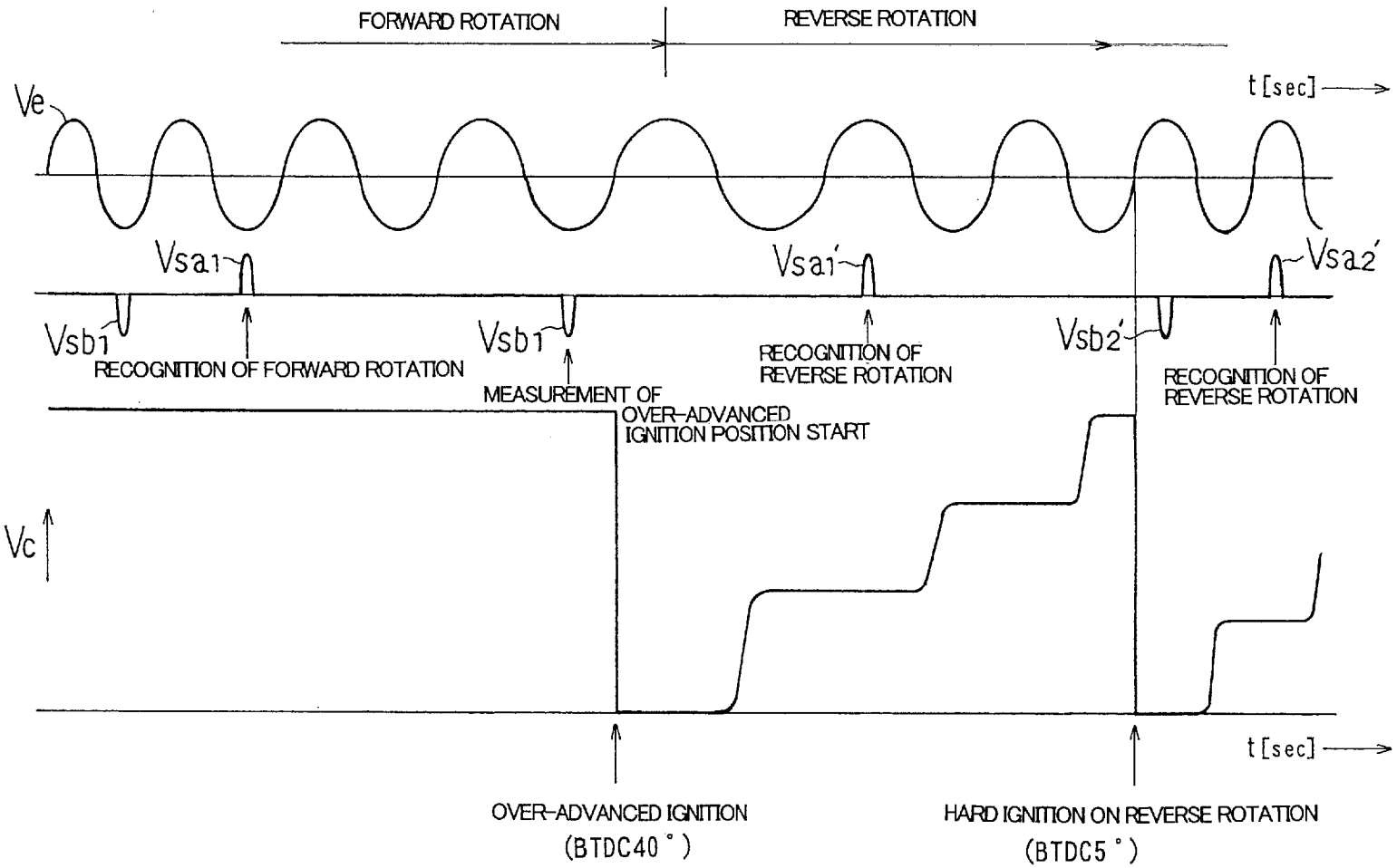
FIG. 3 is a time chart which illustrates the operation of the control system when the forwardly rotating engine should be rotated in the reverse direction.

The time chart illustrating the operation of the internal combustion engine control system of FIG. 1 is shown in FIGS. 3 and 4. FIG. 3 illustrates the operation of the control system when the rotational direction of the engine is changed from the forward one to the reverse one. The condition in which the engine rotating in the forward direction is reversed in the rotational direction after the rotational direction change-over switch 8 is closed is illustrated in FIG. 3 with the horizontal axis indicating a time t (sec.). In FIGS. 3 and 4, "BTDC" means the rotation angle position before the top dead center corresponding to the rotation angle position of the engine at that time.

As the rotational direction change-over switch is closed, the ignition command signal Vi stops being applied to the ignition system 3 and therefore the voltage Vc across the igniting capacitor C1 is kept at the high level as indicated by a left half portion of FIG. 3 C. When the signal generator 2 generates the pulse signal of positive polarity (the pulse signal Vsa1 of positive polarity determining the low speed ignition position of the first cylinder at the forward rotation of the engine), the microcomputer 5 recognizes in view of the polarity of the half wave of the output voltage of the exciting coil EX that the rotational direction of the engine is forward. As the rotational speed gets less than the set value (500 r.p.m.) by misfiring the engine, the microcomputer 5 sets the count value. of the over-advanced ignition position to the igniting timer when the signal generator 2 outputs the pulse signal Vsb1 of negative polarity and the igniting timer starts to make the measurement. The over-advanced ignition position may be set at a position of 40 degree prior to the top dead center (BTDC). As the thus set over-advanced ignition position is measured, the ignition command signal is applied to the ignition system 3. Therefore, the charges stored in the igniting capacitor C1 is discharged and as a result the ignition is made. The voltage Vc across the capacitor C1 gets zero by its discharge. The ignition at the over-advanced position causes the rotational direction of the engine to be reversed.

The microcomputer 5 detects the polarity of the half wave of the output voltage of the exciting coil EX when the pulse signal Vsa1' of positive polarity is generated after the engine rotates in the reverse direction and confirms in view of the polarity of the half wave of the output voltage that the engine is rotating in the reverse direction. The microcomputer 5 detects the specific cross points passing when the output voltage of the exciting coil EX changes from the negative half wave to the positive half wave and makes the hard ignition when it detects the second specific zero cross point (the position advanced at 5 degree prior to the top dead center when the rotation of the engine is reversed). Thereafter, while the rotational speed of the engine is the set value or less than, the hard ignition is made at the zero cross point of the output voltage of the exciting coil EX which correspond to the low speed ignition position. When the rotational speed of the engine exceeds the set value (1000 r.p.m., for example), the soft ignition is made at the arithmetically operated ignition position whereby the steady-state operation in the reverse direction is made.

FIG. 4 shows the operation of changing the rotational direction of the engine from the reverse one to the forward one. The condition in which the engine rotating in the reverse direction is inverted in the rotational direction after the rotational direction change-over switch 8 is opened is illustrated in FIG. 4 with the horizontal axis indicating a time t (sec.).

Figures 4A, 4B, 4C:
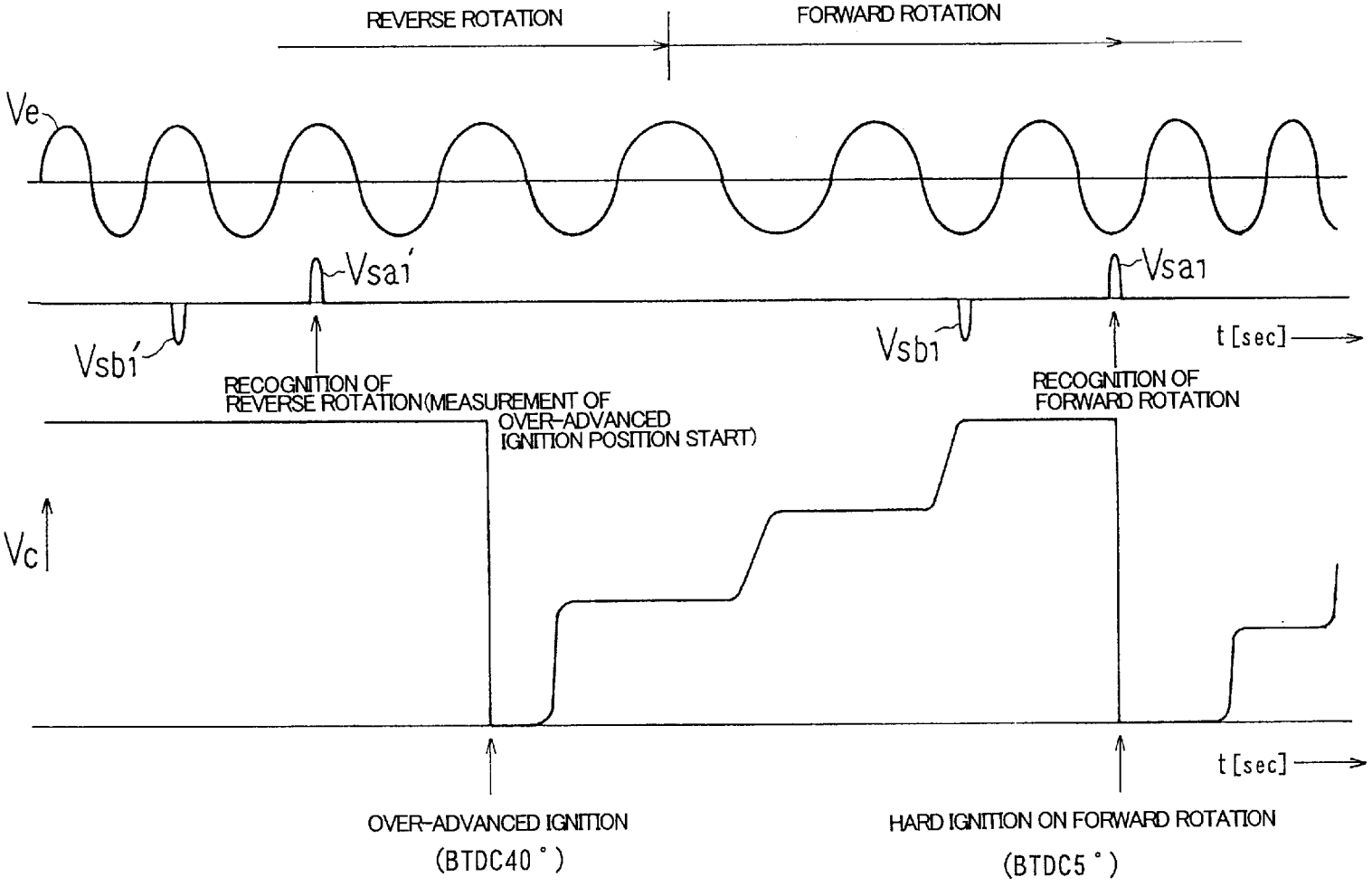
FIG. 4 is a time chart which illustrates the operation of the control system when the reversely rotating engine should be rotated in the forward direction.

As the rotational direction change-over switch is opened in the state of the reverse rotation of the engine, the ignition command signal Vi stops being applied to the ignition system 3 and therefore the voltage Vc across the igniting capacitor C1 is kept at the high level as indicated by a left half portion of FIG. 4C. When the signal generator 2 generates the pulse signal Vsa1' of positive polarity, the microcomputer 5 recognizes in view of the polarity of the half wave of the output voltage of the exciting coil EX that the rotational direction of the engine is the reverse one. As the rotational speed gets less than the set value (500 r.p.m.) when the pulse signal Vsa1' is generated, the microcomputer 5 sets the count value of the over-advanced ignition position to the igniting timer, which starts to make the measurement. The over-advanced ignition position may be set at a position of 40 degree prior to the top dead center (BTDC) in the same manner as in FIG. 3. As the thus set over-advanced ignition position is measured, the ignition command signal is applied to the ignition system 3. Therefore, the charges stored in the igniting capacitor C1 is discharged and as a result the ignition operation is made. The voltage Vc across the capacitor C1 gets zero by its discharge. The ignition at the over-advanced position causes the rotational direction of the engine to be made forward.

The microcomputer 5 detects the polarity of the half wave of the output voltage of the exciting coil EX when the pulse signal Vsa1 of positive polarity is generated after the rotational of the engine is inverted and confirms in view of the polarity of the half wave of the output voltage that the engine is rotating in the forward direction. The ignition command signal is applied to the ignition system as soon as the microcomputer 5 detects that the engine is rotating in the forward direction at the position where the pulse signal Vsa1 is generated and the first ignition (the hard ignition) is made after the rotational direction of the engine is inverted into the forward direction. Thereafter, while the rotational speed of the engine is at the set value or less than, the hard ignition is made at the position of generation of the pulse signal Vsa1 or Vsa2 which corresponds to the low speed ignition position. When the rotational speed of the engine exceeds the set value (1000 r.p.m., for example), the soft ignition is made at the arithmetically operated ignition position whereby the steady-state operation in the forward direction is made.

In the illustrated embodiment, the measurement of the over-advanced ignition position and the measurement of the arithmetically operated ignition position (the soft ignition position) start when the signal generator generates the pulse signal Vsa1' or Vsa2' of positive polarity (one polarity) in order to reverse the rotation direction of the engine. This causes the measurement time of the ignition position to be longer than that when the engine rotates in the forward direction. In order to avoid this, the specific zero cross point selected among the zero cross points of the output of the exciting coil may be the position where the measurement of ignition position starts.

Similarly, the measurement of the ignition position may also start at the specific zero cross point selected among the zero cross points of the output of the exciting coil when the engine rotates in the forward direction.

Although, in the illustrated embodiment, the invention is applied to the two-cylinder two-cycle internal combustion engine, it may be applied to a single cylinder two-cycle internal combustion engine. In case that the invention is applied to the single cylinder internal combustion engine, the position where the measurement of the ignition position starts when the engine rotates in the reverse direction may be one where the signal generator generates the pulse signal because the rotational angle after the signal generator generates the pulse signals of positive or negative polarity until it again generates the pulse signal of positive or negative polarity is 360 degree. Accordingly, in this case, the specific zero cross point of the output of the exciting coil should be the position where the measurement of the ignition position starts.

Although, in the illustrated embodiment, the specific zero cross point of the output voltage of the exciting coil (the coil for driving the ignition system) provided within the magneto generator serves as the ignition position at the low speed reversion or as the position where the measurement of the ignition position starts, the zero cross point of the output voltage of a generation coil other than the exciting coil may be used as the ignition position at the low speed reversion or as the position where the measurement of the ignition position starts. In case that the magneto generator has enough output and a generation coil wound on one of the magnetic poles of the stator can be used as the generation coil exclusively for. the control system (the generation coil supplying no electric power to the load), the zero cross point of the output voltage of the generation coil may be used as the ignition position or the position where the measurement of the ignition position starts. This enables the low speed ignition position or the position where the measurement starts to be accurately determined without any affect of armature reaction.

As aforementioned, according to the invention, since the rotational direction of the engine is judged from the polarity of the half wave of the output voltage of the magneto generator when the signal generator generates the output pulses in order to confirm the rotational direction of the engine after it is inverted, the rotational direction of the engine can be judged by using only one signal generator, which can prevent the construction of the engine from being complicated.

Although one preferred embodiment of the invention has been described and illustrated with reference to the accompanying drawings, it will be understood by those skilled in the art that it is by way of example, and that various changes and modifications may be made without departing from the spirit and scope of the invention, which is defined only to the appended claims.

What is claimed is:

1. A control system for an internal combustion engine comprising a rotational direction change-over switch to be operated when a rotational direction of the two-cycle internal combustion engine should be reversed and a microcomputer to perform a speed reduction step to reduce a rotational speed of said internal combustion engine when said rotational direction change-over switch is operated, an over-advance angle control step to advance an ignition position of said internal combustion engine to an over-advance position when said rotational speed is reduced to less than a set value, a rotational direction judgment step to judge the rotational direction to confirm whether the rotational direction of said internal combustion engine is reversed by said over-advance angle of said ignition position and a reversion initial ignition step to ignite said internal combustion engine at the low speed ignition position in the condition of reversing said rotational direction when the reversion of said rotational direction is confirmed, said control system further comprising an AC magneto generator constructed to generate an AC output voltage of 2n cycles ("n" is an integral number of more than 1) per revolution of said internal combustion engine with a phase of said AC output voltage being set so that either of zero cross points of said AC output voltage corresponds to said low speed ignition position on the reverse rotation of said internal combustion engine; a single signal generator constructed to generate a pulse signal of one of the polarities and a pulse signal of other polarity in synchronization with said rotation of said internal combustion engine with generation positions of said pulse signals being set so that said pulse signals of one polarity and of other polarity are generated at said low speed ignition position on the forward direction of said internal combustion engine and at the position advanced relative to said low speed ignition position, respectively and so that the polarity of one half wave of said AC output voltage of said magneto generator when said pulse signal of one polarity is generated is identical to the polarity of one half wave of said AC output voltage of said magneto generator when said pulse signal of other polarity is generated; and said microcomputer adapted to judge said rotational direction of said internal combustion engine from the polarity of said half wave of said AC output voltage when said single signal generator generates said pulse signal of either polarity.

2. A control system for an internal combustion engine comprising a rotational direction change-over switch. to be operated when a rotational direction of the two-cycle internal combustion engine should be reversed; an AC magneto generator constructed to generate an AC output voltage of 2n cycles ("n" is an integral number of more than 1) per revolution of said internal combustion engine with a phase of said AC output voltage being set so that either of zero cross points of said AC output voltage corresponds to said low speed ignition position on the reverse rotation of said internal combustion engine; a signal generator constructed to generate a pulse signal of one polarity and a pulse signal of other polarity in synchronization with said rotation of said internal combustion engine with generation positions of said pulse signals being set so that said pulse signals of one polarity and of other polarity are generated at said low speed ignition position on the forward rotation of said internal combustion engine and at the position advanced relative to said low speed ignition position of said forward rotation of said engine, respectively and so that the polarity of half wave of said AC output voltage of said magneto generator when said pulse signal of one polarity is generated is identical to the polarity of half wave of said AC output voltage of said magneto generator when said pulse signal of other polarity is generated; rotational direction judgment means to judge said rotational direction of said internal combustion engine from the polarity of said half wave of said AC output voltage when said signal generator, generates the pulse signal of either polarity; ignition position arithmetical operation means to arithmetically operate the ignition positions of said internal combustion engine when it rotates forwardly and reversely at a set value or more than of said rotational speed, respectively; steady-state operation ignition control means to ignite said internal combustion engine when said ignition position arithmetically operated by said ignition position arithmetical operation means is detected in the condition where said internal combustion engine rotates forwardly and reversely at said set value or more than of said rotational speed, to ignite said internal combustion engine when said pulse signal of one polarity generated by said signal generator is detected in the condition where said internal combustion engine forwardly rotates at less than said set value of said rotational speed and to ignite said internal combustion engine when said zero cross point of said AC output voltage corresponding to said low speed ignition position of the reverse rotation is detected in the condition where said internal combustion engine reversely rotates at less than said set value of said rotational speed; rotational direction change-over means including speed reduction means to reduce said rotational speed of said internal combustion engine when said rotational direction change-over switch is operated, ignition position over-advance means to ignite said internal combustion engine at an advance angle position necessary for reversing said rotational direction of said internal combustion engine when said rotational speed is reduced to less than a set value and reversion initial ignition control means to ignite said internal combustion engine at a reversion initial ignition position suitable for a first ignition position after said rotational direction is reversed when the reversion of said rotational direction of said internal combustion engine is judged by said rotational direction judgment means; said rotational direction change-over control means adapted to decide said reversion initial ignition position when the rotational direction of said internal combustion engine is changed from the forward direction to the reverse direction on a rotation angle position information obtained from zero cross points of said AC output voltage of said magneto generator and set said reversion initial ignition position when said rotational direction of said internal combustion engine is changed from the reverse direction to the forward direction, at a position where said signal generator generates the pulse signal of one-polarity.

3. A control system for an internal combustion engine as set forth in claim 2 and wherein said steady-state operation ignition control means is so constructed to start a measurement of said ignition position arithmetically operated by said ignition position arithmetical operation means when said signal generator detects the pulse signal of other polarity during the forward rotation of said internal combustion engine to ignite said internal combustion engine after said measurement of said ignition position ends and to start a measurement of said arithmetically operated ignition position when said signal generator detects the pulse signal of one polarity during the reverse rotation of said internal combustion engine to ignite said internal combustion engine after said measurement of said ignition position ends.

4. A control system for an internal combustion engine as set forth in claim 2 and wherein said steady-state operation ignition control means is so constructed to start a measurement of said ignition position arithmetically operated by said ignition position arithmetical operation means when a specific zero cross point of said AC output voltage is detected to ignite said internal combustion engine after said measurement of said ignition position ends.

5. A control system for an internal combustion engine as set forth in claim 2 and wherein said steady-state operation ignition control means is so constructed to start a measurement of said ignition position arithmetically operated by said ignition position arithmetical operation means when said signal generator detects the pulse signal of other polarity on the forward rotation of said internal combustion engine to ignite said internal combustion engine after said measurement of said ignition position ends and to start a measurement of said ignition position arithmetically operated by said ignition position arithmetical operation means when a specific zero cross point of said AC output voltage is detected on the reverse rotation of said internal combustion engine to ignite said internal combustion engine after said measurement of said ignition position ends.

6. A control system for an internal combustion engine as set forth in either of claims 2 through 5 and wherein said speed reduction control means comprises means to stop an operation of an ignition system to ignite said internal combustion engine to misfire said internal combustion engine.

* * * * *